US005752348A

United States Patent [19]

Pearson

[11] Patent Number: 5,752,348

[45] Date of Patent: May 19, 1998

[54] WINDOW WELL COVER

[76] Inventor: Charles H. Pearson, 965 Sandy Cir., Manahawkin, N.J. 08050

[21] Appl. No.: 690,454

[22] Filed: Jul. 1, 1996

[51] Int. Cl.[6] ..... E04F 17/06

[52] U.S. Cl. ..... 52/107; 52/169.6

[58] Field of Search ..... 52/107, 169.6

[56] References Cited

U.S. PATENT DOCUMENTS 2,237,564 4/1941 Keyes ..... 52/107

3,046,613 7/1962 Smith ..... 52/107

5,339,579 8/1994 Woodyer et al. ..... 52/107

*Primary Examiner*—Creighton Smith

*Attorney, Agent, or Firm*—Clifford G. Frayne

[57] ABSTRACT

There is disclosed a window well cover having a base member which has a horizontal and vertical component which is cooperable with the parallel surfaces of the window well, the foundation of the building, and the lower edge of the siding or sheathing of the building to secure the base member in position, the base member having parallel inclined inner sidewalls for receipt of a protective cover securable to the window well foundation.

8 Claims, 4 Drawing Sheets

WINDOW WELL COVER

BACKGROUND OF THE INVENTION

1. Field of the Invention

The present invention is directed to a novel and useful window well cover which affords protection for the well itself and is cooperable with the siding or facing of the structure.

2. Description of the Prior Art

In current construction, a window well is typically a cement or cinder block constructed structure depending outwardly from the foundation of the building, the well normally having a concrete base and allowing access to a window, grate, or door in the foundation of the structure.

A structure having a full basement might have a window positioned in the structure foundation, and hence, the window well would allow the access of light to this window and into the basement area.

Applicant's window well cover is designed primarily for use with structures in which there is no full basement, but rather, a crawlspace formed between the ground and the first floor of the structure and enclosed by the foundation of the structure.

As a result, some of the prior art window well covers designed to enclose the window well, but allow light to pass through, are not the primary objective of Applicant's invention. Some of these prior art patents with respect to the illumination aspect of the window well cover include U.S. Pat. No. 2,898,638 to Druckhamer; U.S. Pat. No. 2,761,180 to Krelwitz; U.S. Pat. No. 3,046,613 to Smith.

Additional prior art patents directed to window well covers and not necessarily associated with the passage of illumination include U.S. Pat. No. 3,703,791 to Slade; U.S. Pat. No. 2,793,688 to Robey; and U.S. Pat. No. 2,308,131 to Wellnitz.

Applicant's window well cover is designed to be secured to the window well such that it is cooperable with the cement or concrete block construction of the window well and simultaneously cooperable with the lower edge of the siding or facing of the structure to which the window well is secured. In addition, Applicant's window well cover is designed so as to not only prevent the accumulation of debris in the window well, but to also divert rain water and melting snow away from the foundation.

OBJECTS OF THE INVENTION

It is an object of the present invention to provide for a novel window well cover to prevent the accumulation of leaves or other debris within the window well.

It is a further object of the present invention to provide a novel window well cover which will divert rain water or melting snow away from the foundation.

It is a still further object of the present invention to provide for a novel window well cover which has a removable securable lid.

It is a still further object of the present invention to provide for a novel window well cover which is securable to the window well itself and is simultaneously cooperable with the lower edge of the siding or facing of the structure to which the window well is attached.

SUMMARY OF THE INVENTION

A window well cover having a base member which has a horizontal and vertical component which is cooperable with the parallel surfaces of the window well, the foundation of the building, and the lower edge of the siding or sheathing of the building to secure the base member in position, the base member having parallel inclined inner sidewalls for receipt of a protective cover securable to the window well foundation.

BRIEF DESCRIPTION OF THE DRAWINGS

These and other objects and advantages of the instant invention will become evident, particularly when taken in light of the following illustrations wherein.

DETAILED DESCRIPTION OF THE DRAWINGS

Figure 1:
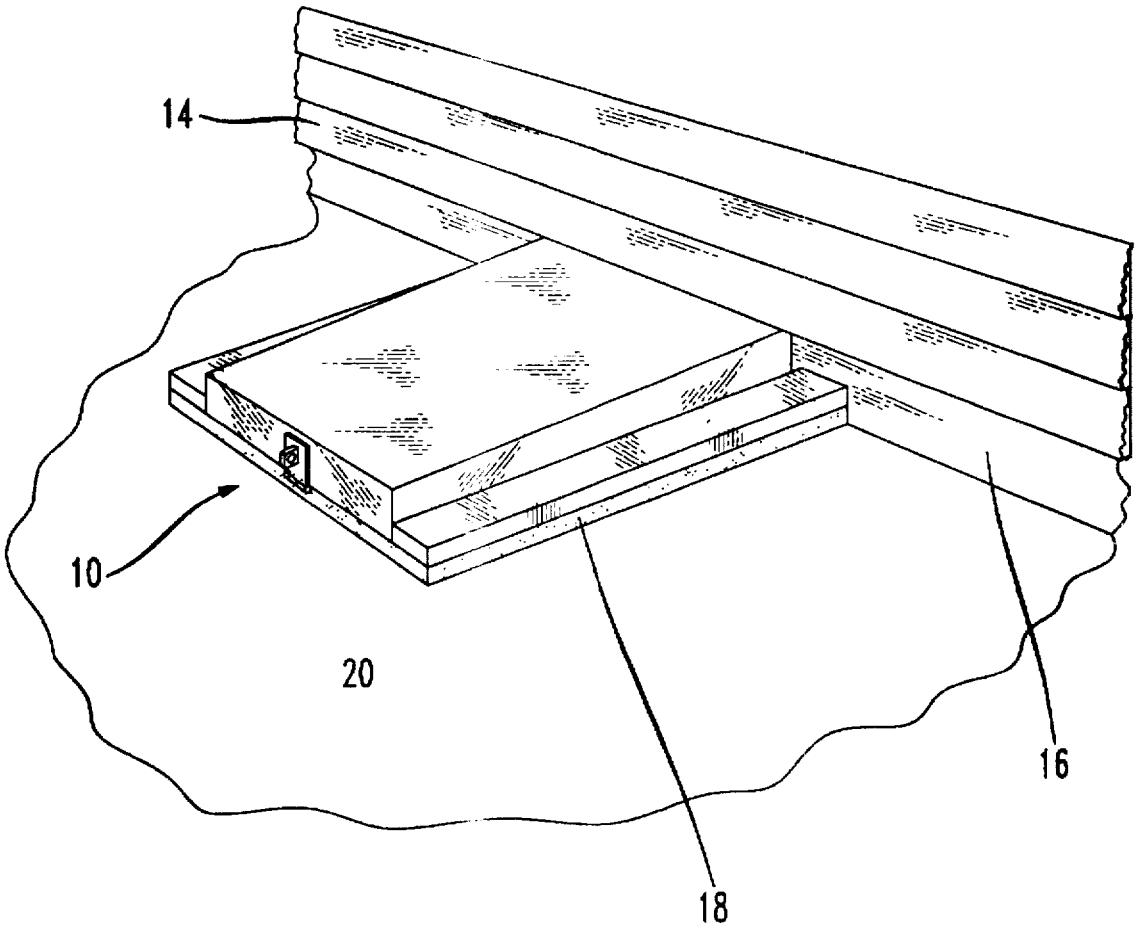
FIG. 1 is a perspective view of the window well cover in a secured position over the window well.

FIG. 1 is a perspective view of the window well cover 10 in a secured position on a dwelling. As illustrated in FIG. 1, there is an outer wall 12 of dwelling unit, which has a plurality of siding members 14 covering its outer surface. Siding members 14 could be vinyl siding, clapboard or any other similar building material. The siding members 14 protect and cover the underlying sheathing construction material and a plurality of siding members 14 terminate proximate to the upper edge of the foundation 16. In this typical construction where a crawlspace is available under the first floor of the dwelling unit and enclosed by the foundation 16, a window well 18 (not shown) covered by the window well cover extends outwardly from foundation 16 and allows access to a grate, door or the like from the window well 18 to the inside portion of foundation 16.

The window well 18 of FIG. 1 is not entirely visible in that FIG. 1 illustrates the positioning of Applicant's window well cover 10 in a secured position over the window well opening.

Figure 2:
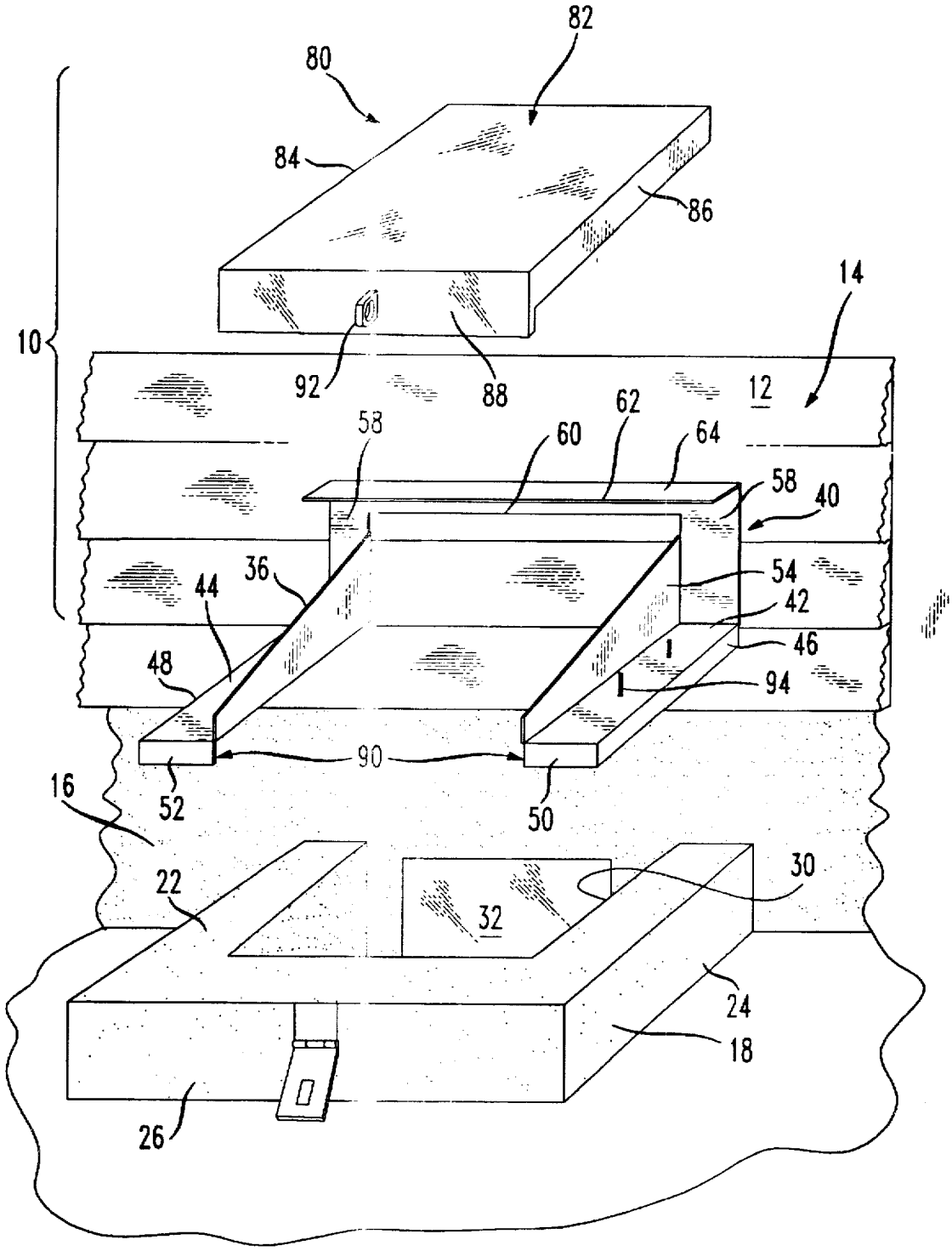
FIG. 2 is an exploded view of the window well and window well cover.

FIG. 2 is an exploded perspective view of window well cover 10, window well 18, foundation 16, and the sidewall of the dwelling unit 12, with the plurality of construction members 14.

FIG. 2 illustrates the manner in which the foundation 16 extends above the ground 20 to a certain height at which point, the construction materials forming the outer wall of the dwelling unit extend upwardly. The sheathing associated with the enclosure of the outer walls is covered by a plurality of siding members 14 which extend upwardly covering the outer surface of the wall 12 from a point proximate to the upper termination of the foundation 16, to the roof of the structure. Siding elements 14 extend outwardly from the underlying sheathing and outwardly from the foundation 16 so as to form a horizontal lip which will be more evident and more fully explained with reference to FIGS. 3 and 4.

The window well 18 itself is generally rectangular-shaped having parallel sidewalls 22 and 24 which extend outwardly from foundation 16 and a front wall 26 which extends between sidewalls 22 and 24. The window well 18 presents an upper planar surface 28 which is normally positioned several inches above ground 20.

Window well 18 defines a chamber defined by sidewalls 22 and 24 and front wall 26 and foundation wall 16. The bottom of chamber 30, as is evident from reference to FIGS. 3 and 4, constitutes a concrete pad normally which is coextensive with the aforementioned sidewalls of the window well and the foundation wall.

Typically, there is positioned in window well 18, an access door or grate 32 which covers and protects a passageway or opening 34 through foundation 16, providing access to the crawlspace defined by foundation 16 and floor of the dwelling unit. It is this access door or grate 32 and the chamber 30 itself which Applicant's window well cover is designed to protect.

The window well cover itself is comprised of two elements which, because of cost and ease of fabrication, would preferably be fabricated from sheet metal, but could be fabricated from any other suitable material. The first element of window well cover 10 is base 40 which is cooperable with the window well 18, foundation 16, and the aforementioned lip, formed by the plurality of siding members 14.

Foundation member 40 is generally rectangular-shaped having two planar seating members 42 and 44 which are longitudinally dimensioned to conform to the length of sidewalls 22 and 24 of window well 18. Seating members 42 and 44 have downwardly depending lips 46 and 48, respectively along their longitudinal outer edge and a depending front lip 50 and 52, respectively along the front edge. In this configuration, the seating members 42 and 44 are designed to be coextensive with the upper planar surfaces of sidewalls 22 and 24 and lips 46, 48, 50 and 52 extend downwardly along the sidewalls 22 and 24 and a portion of front wall 26.

Seating members 42 and 44 have depending upwardly from their inner edge, vertical struts 54 and 56 which are sloped upwardly from the front portion of seating members 42 and 44 having depending lips 50 and 52 to a predetermined height. Strut members 54 and 56 terminate in a planar back wall 58, planar back wall 58 extending upwardly from the rear edge of seating members 42 and 44 and defining two vertical portions of the backplate 58 and a horizontal portion 60 which extends between the vertical portions of backplate 58.

Backplate 58 has an upper edge 62 which is bent to form a horizontal lip 64, lip 64 extending forwardly from backplate 58.

In this configuration, the foundation member 40 is dimensioned such that the rear face of backplate 58 is in contact with the outer face of foundation 16, seating members 42 and 44 have their underside in communication with or in contact with the upper planar surface 28 of window well 18 and depending lips 46, 50, 48 and 52 are in communication with the sidewall of window well 18. Outwardly extending lip 64 is in communication contact with the lip of the lowermost siding member 14 secured to wall 12. In this configuration, the foundation member 40 can be positioned on window well 18 by sliding it into communication contact with the aforesaid foundation 40 elements and the window well and dwelling foundation elements.

The second element of window well cover 10 is a cover 80 having a planar upper surface 82, depending sidewall lips 84 and 86 and a front lip 88. Cover 80 is dimensioned such that it is slidably positioned on foundation 40 such that the sidewall lips 84 and 86 engage the outer surface of struts 54 and 56 and front lip 88 extends downwardly to cover the gap 90 formed between seating members 42 and 44. The front lip 88 of cover 80 is equipped with a latching device 92 cooperable with the latching device formed in the front wall 26 of window well 18 to secure the cover in place with a lock or other suitable securing mechanism.

In the design as shown, the foundation 40 could be secured to the window well 18 with a plurality of concrete fasteners 94 positioned through seating members 42 and 44 and into upper planar surface 28 of window well 18 as well as a plurality of concrete fasteners positioned through backplate 58 and into foundation 16. In addition, the window well cover 10 is further secured by the cooperation between lip 64 and the lower lip of the siding members 14 to secure the positioning of the window well cover and its ability to withstand dislodgement.

Figure 3:
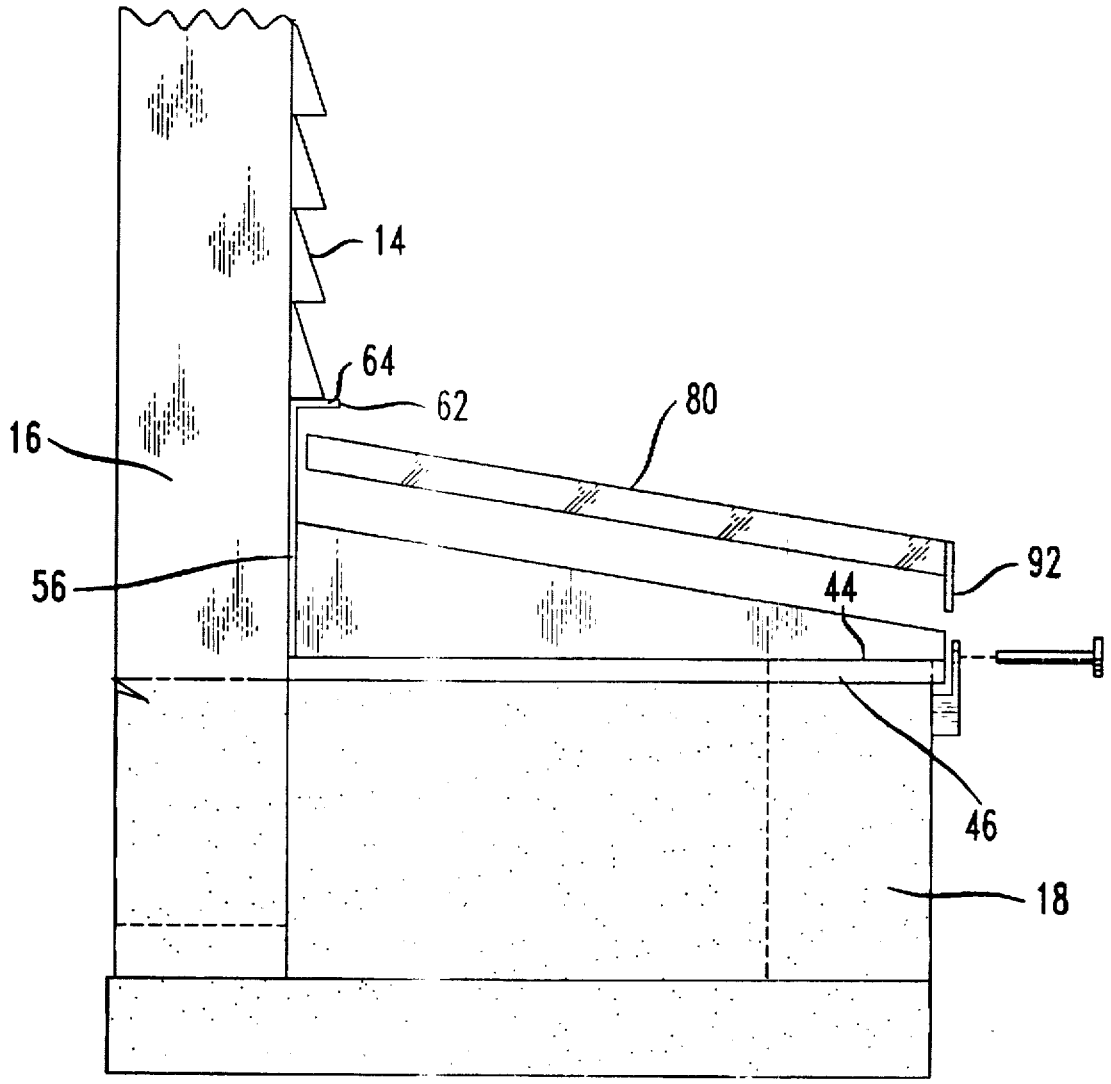
FIG. 3 is a side view of the window well cover.

FIG. 3 is a side elevational view of window well cover 10 which provides an enlarged view showing the cooperation between back plate 58 and its upper edge 62 which is bent to form a horizontal lip 64, such that lip 64 is engageable with the underside of the lowermost horizontal siding member 14 on the dwelling unit. Further, FIG. 3 illustrates the manner in which front face 88 of cover 80 has a downwardly extending lip, such that it is engageable with a securing means 92 secured to the front concrete face 26 of the window well, such that downwardly depending front face 88 can engage the securing means and align apertures therein for receipt of any suitable securing means which will maintain the cover 80 in position yet allow it to be removably displaced for access to the window well and the crawlspace.

Figure 4:
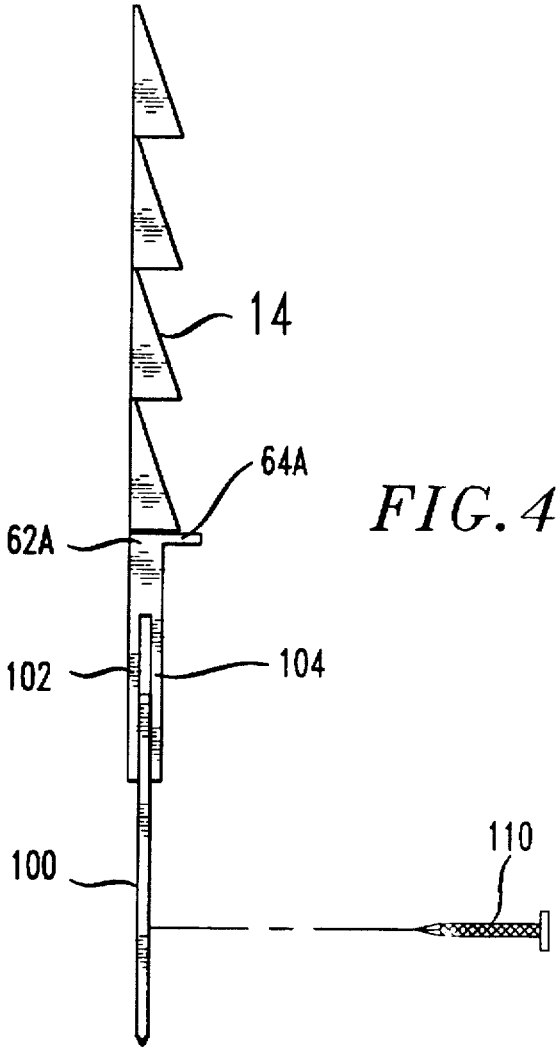
FIG. 4 is an partial elevational view of a second embodiment of the window well cover.
Figure 5:
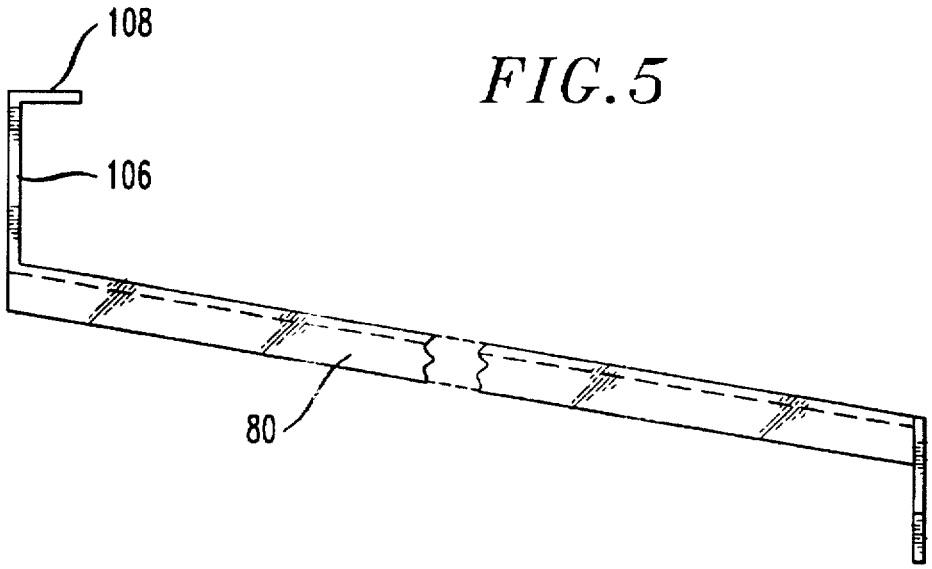
FIG. 5 is a side elevational view of a third embodiment of the window well cover.

FIG. 4 and FIG. 5 illustrate alternative embodiments for securing the window well cover to the window well in cooperation with the siding panels on the dwelling unit. FIG. 4 is a partial side elevational view illustrating an adjustable back plate 58 which includes a fixed portion 100 which is illustrated in the preferred embodiment would be fixed to planar members 42 and 44. However, in order to accommodate differing heights where measurements were not taken or not accessible, yet the desire is still there to have cooperation with the lowermost siding member 14, there would be a slidably engageable portion of the back plate 102 having a defined channel 104 for receipt of fixed portion 100, such that slidable portion 102 could be adjusted upwardly to engage the lowermost siding member 14 with upper edge 62A and lip 64A.

FIG. 5 is a side elevational view of cover 80 which presents a third embodiment for those instances where the lowermost siding member 14 is horizontally positioned relatively close to the top surface 28 of window well 20. In this instance, the upper surface 82 of cover 80 along its rear edge, can be fabricated into an upwardly extending vertical member 106 having a horizontal lip 108, such that this vertical surface 106 and lip 108 would cooperate with either the upper surface 62 and lip 64 of foundation member 40 or in the alternative, cooperate directly with the undersurface of the lowermost siding member 14 on the dwelling unit. In either instance, cover 80, as illustrated in FIG. 5, would still be secured to the front surface 26 of window well 30 by means of fastening means previously discussed. Further, with respect to the second embodiment as illustrated in FIG. 4, in order to maintain the slidable arrangement of lower member 100 and upper member 102, fastening means 110 could be utilized at appropriate locations in order to secure these members to foundation 16.

While the present invention has been described in connection with the exemplary embodiment thereof, it will be understood that many modifications will be apparent to those of ordinary skill in the art and the application is intended to cover any adaptations or variations thereof. Therefore, it is manifestly intended that the invention be only limited by the claims and the equivalents thereof.

What is claimed is:

1. A window well cover cooperative with a window well foundation, a foundation of a building, and an exterior sheathing of a building, said window well cover comprising:

a building having a foundation and outer walls, said foundation having a window well formed on an exterior side of said foundation, said window well generally rectangular in shape having an outer periphery and an inner periphery defining an upper planar surface of two parallel surfaces and a perpendicular planar surface said window well depending downwardly from above ground level for access to a window or an access door in said foundation;

exterior sheathing on said outer wall of said building, said exterior sheathing having a lower edge proximate to said foundation;

a window well cover comprising a base member having two parallel planar horizontal surfaces generally rectangular in shape and dimensioned to be coincidental with said two parallel surfaces of said window well and having an inner edge and outer edge, said parallel planar horizontal surfaces of said window well cover each having a vertical perpendicular back plate secured to one end thereof, said back plates comprising vertical surfaces having a lower end secured to said horizontal planar surfaces and an upper end, each said back plate having an inner edge and an outer edge aligned with said inner edge and said outer edge of said parallel planar horizontal surfaces, said vertical back plates be by a perpendicular cross member at said upper ends of said plates, said cross member having an upper edge, said upper edge of said cross member having a horizontal lip formed therealong, parallel inclined vertical walls formed on said inner edges of said horizontal base member and said vertical back plates, said inclined vertical walls incline downwardly from said vertical backplates towards said perpendicular planar surface of said window well;

a planar cover generally rectangular in shape having depending vertical lips formed along two side edges and a front edge said planar cover engageable with said parallel inclined vertical walls of said base member and removeably securable to said window well by a fastening means.

2. The window well cover in accordance with claim 1 wherein said parallel planar horizontal surfaces of said base member have depending lips formed on said outer edges and front edges thereof engaged with a portion of the outer periphery of said window well.

3. The window well cover in accordance with claim 2 wherein said vertical perpendicular back plates of said base member are dimensioned to a height such that said horizontal lip of said upper edge of said cross member of said vertical back plates is engageable with said lower edge of said sheathing of said building thereby securing said base member in position.

4. The window well cover in accordance with claim 3 wherein a height of said vertical perpendicular back plates is adjustable to ensure engagement by said horizontal lip of said cross member of said vertical back plates with said lower edge of said sheathing of said building.

5. The window well cover in accordance with claim 4 wherein the inclination of said incline vertical walls formed on said inner edges of said horizontal base members and said vertical back plates is adjustable for determination of a pitch of said planar cover.

6. The window well cover in accordance with claim 5 wherein said planar cover has formed on a rear edge thereof a vertical back plate having a horizontal lip across its upper edge, said vertical back plate of said planar cover dimensioned so as to engage with said horizontal lip of said cross member of said vertical back plates of said base member.

7. The window well cover in accordance with claim 6 wherein said base member is secured to said upper planar surface of said window well and said foundation wall by a fastening means.

8. The window well cover in accordance with claim 7 wherein said front edge of said planar cover has a locking means cooperative with a locking means secured to said window well.

* * * * *